US011781337B2

(12) United States Patent
Beisser, III

(10) Patent No.: US 11,781,337 B2
(45) Date of Patent: Oct. 10, 2023

(54) APPARATUS, SYSTEM, AND METHOD FOR CREATION OF FENCES AND RELATED STRUCTURES USING T-POSTS

(71) Applicant: Franz X Beisser, III, Bedford, VA (US)

(72) Inventor: Franz X Beisser, III, Bedford, VA (US)

( * ) Notice: Subject to any disclaimer, the term of this patent is extended or adjusted under 35 U.S.C. 154(b) by 204 days.

(21) Appl. No.: 17/002,711

(22) Filed: Aug. 25, 2020

(65) Prior Publication Data

US 2021/0079685 A1 Mar. 18, 2021

Related U.S. Application Data

(60) Provisional application No. 62/891,379, filed on Aug. 25, 2019.

(51) Int. Cl.

| | |
|---|---|
| ***E04H 17/22*** | (2006.01) |
| ***E04H 17/08*** | (2006.01) |
| ***E04H 17/14*** | (2006.01) |

(52) U.S. Cl.

CPC ..... *E04H 17/22* (2013.01); *E04H 17/08* (2013.01); *E04H 17/146* (2021.01)

(58) Field of Classification Search

CPC . E04H 17/14; E04H 17/1413; E04H 17/1447; E04H 17/1448; E04H 17/146; E04H 17/1473; E04H 17/1488; E04H 17/20; E04G 21/32; E04G 21/3214; E04G 21/3223

See application file for complete search history.

(56) References Cited

U.S. PATENT DOCUMENTS 4,077,611 A * 3/1978 Wilson ..... A01K 3/005 256/10
4,078,754 A * 3/1978 Gould ..... E04H 17/06 403/313
4,936,550 A * 6/1990 Wickham ..... E04H 17/1413 403/4
5,996,973 A * 12/1999 Campbell ..... E04H 17/08 256/73
6,619,627 B2 * 9/2003 Salisbury ..... A01K 3/00 256/10

(Continued)

*Primary Examiner* — Jonathan P Masinick
(74) *Attorney, Agent, or Firm* — IPCL Group, PLC; Anthony Tacconi, Esq.

(57) ABSTRACT

The present invention teaches an apparatus, system, and method for hanging or supporting lumber or similar materials using standard metal t-post which can be used to construct fences or outdoor structures. A first iteration, incorporating fence bracket disclosed herein, eliminates the need for the use of wooden posts to erect a wooden board fence. A second iteration, incorporating a lumber bracket, is used to attach construction lumber to a plurality of t-posts in order to form a basic support structure, in whole or in part, for a variety of outbuildings. The two variations of the bracket may be used independently, or in conjunction with one another, depending on the particular application. The system may be used to erect a new board fence, transition from an existing wire t-post fence to a board fence, and to construct, or assist in the construction of, sheds, coops, barns, and other similar outbuildings.

2 Claims, 14 Drawing Sheets

(56) References Cited

U.S. PATENT DOCUMENTS

| | | | | |
|---|---|---|---|---|
| 8,132,792 | B2 * | 3/2012 | Perris | E04G 21/3223 182/113 |
| 8,480,061 | B2 * | 7/2013 | Graves | E04H 17/20 248/220.21 |
| 9,683,695 | B2 * | 6/2017 | Bishop | G08B 5/38 |
| 10,487,979 | B2 * | 11/2019 | Simons | F16M 13/02 |
| 10,619,377 | B2 | 4/2020 | Beisser | |
| 10,982,454 | B2 * | 4/2021 | Melic | E04G 21/3223 |
| 2015/0300558 | A1 * | 10/2015 | Bishop | A01K 3/005 248/219.4 |
| 2017/0167160 | A1 * | 6/2017 | Beisser, III | E04H 17/266 |

* cited by examiner 145
146
124
150
148
101
124
151
147
100
143
142
146

154
125
146
125
147
155
152

APPARATUS, SYSTEM, AND METHOD FOR CREATION OF FENCES AND RELATED STRUCTURES USING T-POSTS

This application claims priority from U.S. Provisional Patent Application No. 62/891,379 filed on Aug. 25, 2019.

FIELD OF THE INVENTION

The present invention relates to the installation and construction of fences, sheds, and other similar enclosed and semi-enclosed structures using t-posts as a basis for construction.

BACKGROUND OF THE INVENTION

Agricultural fences and similar enclosures are often constructed using metal posts having a t-shaped cross-section, generally known as t-posts. These t-posts can be used as the principal supporting structure of both temporary and permanent fences. Fences incorporating such t-posts are considerably less expensive, and generally easier and faster to install, than fences using wooden posts as anchors. Even with these benefits, t-post fences have, traditionally, had certain drawbacks, e.g., wooden posts were required for corners and bracing purposes and power equipment was typically necessary to install such wooden posts. A novel solution to the foregoing difficulties using t-braces has been set forth in prior U.S. Pat. No. 10,619,377 B2 ('377 patent).

T-post fences are traditionally constructed by stringing wire, barbed or smooth, along a series of t-posts. Even with the addition of the improvements set forth in the '377 patent, a wire fence may still not be ideal or desirable and a board fence may be preferred. There is, therefore, a need for a means to construct a fence having wooden board components but still avoiding the use of heavy equipment and other such difficulties. More specifically, there is a need for a system and method to build a board fence, at least in part, which relies upon the t-posts for bracing and support.

Many of the same difficulties or issues also apply to the construction of enclosed or semi-enclosed outbuildings using wooden posts. Digging with heavy equipment, backfilling, pouring concrete or other such means are often required to erect wooden sheds and similar enclosures. There would be, therefore, a great benefit to a system and method which relies upon the ease of installation and use of t-posts to assist in the construction of wooden structures and enclosures.

Object of the Invention

The invention provides many advantages and benefits. Among many objects of the invention, it is an object of the invention:

To permit the erection of a fence by one person using essentially no equipment other than a manual post pounder;

To eliminate the chore of digging deep holes, either by hand or heavy equipment to install wooden posts for a fence;

To eliminate the need for concrete post hole footings, backfilling, tamping and replanting in the area when installing a board fence;

To facilitate a conversion from a wire fence to a board fence without having to remove existing t-posts;

To permit the use metal t-posts instead of wooden posts to construct outbuildings; and, To permit the mounting of lumber or hanging of siding or boards from standard metal t-posts in order to create one or more walls or a roof for an outbuilding or similar structure.

SUMMARY OF THE INVENTION

The present invention teaches an apparatus, system, and method for hanging or supporting lumber or similar materials using standard metal t-posts in order to construct fences or outdoor structures. The system includes a mounting bracket having two iterations and methods of using same.

The first embodiment of the bracket, referred to as the fence bracket, is used to horizontally mount lumber, or similar materials, on a series of standard metal t-posts. The second embodiment of the bracket, referred to as the lumber bracket, is also used to mount lumber to a t-post and is designed, in part, to facilitate the use of a t-post as a vertical support for building structures instead of using wooden posts. The two variations of the bracket may be used independently, or in conjunction with one another, depending on the particular application. The lumber bracket is reversible and can be used to mount lumber at a 90 degree angle to mounted lumber on a fence bracket. The system may be used to erect a new board fence, transition from an existing wire t-post fence to a board fence, and to construct, or assist in the construction of, sheds, coops, barns, and other similar outbuildings.

DETAILED DESCRIPTION

The invention consists of a mounting bracket to be used in conjunction with a plurality of standard metal t-posts in order to construct a board fence, or similar barrier, or to construct, in whole or in part, enclosed or semi-enclosed outdoor structures. Two embodiments of the mounting bracket are disclosed herein, the first embodiment of the mounting bracket is referred to as a fence bracket and the second embodiment of the mounting bracket is referred to as a lumber bracket.

Figure 1A:
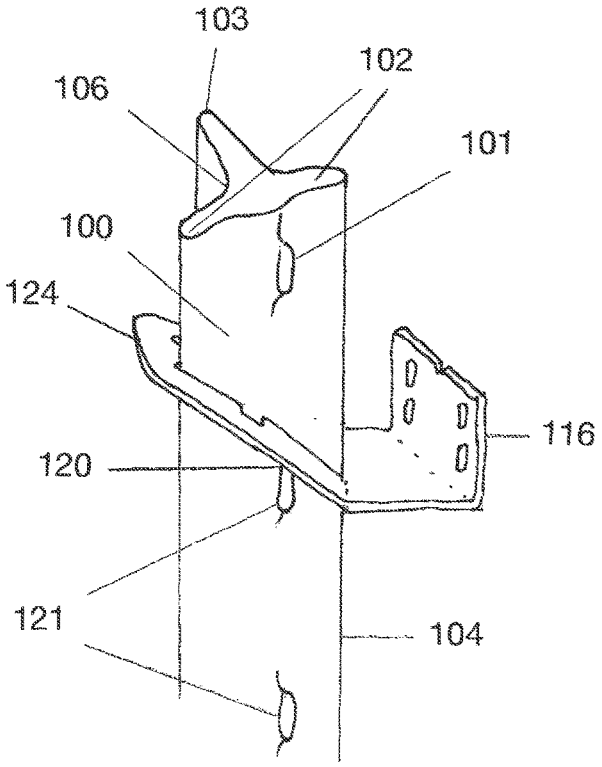
FIG. 1A is a perspective view of a lumber bracket installed on a t-post.

The bracket allows construction lumber, or similar material, to be mounted on three sides of a standard metal t-post. A conventional t-post is shown in FIG. 1A. The t-post-100 is in the general shape of "T" which is defined by two wings 102, two coves 106, and the long portion of the "T" 103. The t-post also includes a plurality of knobs 101, 121 along the length of the post.

The brackets can be used to support lumber or similar materials in order to construct fences and to convert existing wire t-post fences to fences having wooden components. A fence constructed using this system has both the advantages of a board fence and the ease and flexible installation of a t-post fence. The brackets are also able to hold up construction lumber that will be able to carry a flat roof with purlins or gabled roofs with trusses, as well as mounting lumber to install various siding. Further the invention allows one to utilize part of a board fence, erected with either of the two brackets, or in combinations thereof, as a side or back wall for a shed. The same principal can be applied, by simply adding a roof and utilizing a backyard corner of a boarded fence, to easily complete two side of a wood shed.

Fence Bracket

As seen in FIGS. 11A, 12A-B, and 13, the fence bracket is an elongated body which is designed to securely mount upon a standard t-post. It is composed of galvanized steel or other material having suitable strength and corrosion resistant properties. The bracket consists of three principal sections, the mounting portion 2210, the cradle section 2201, and the cradle flange 2231 which extends orthogonally from the cradle section 2201. The fence bracket can be securely mounted on the projections, namely the knobs and wings, of all standard metal t-posts.

Figure 12A:
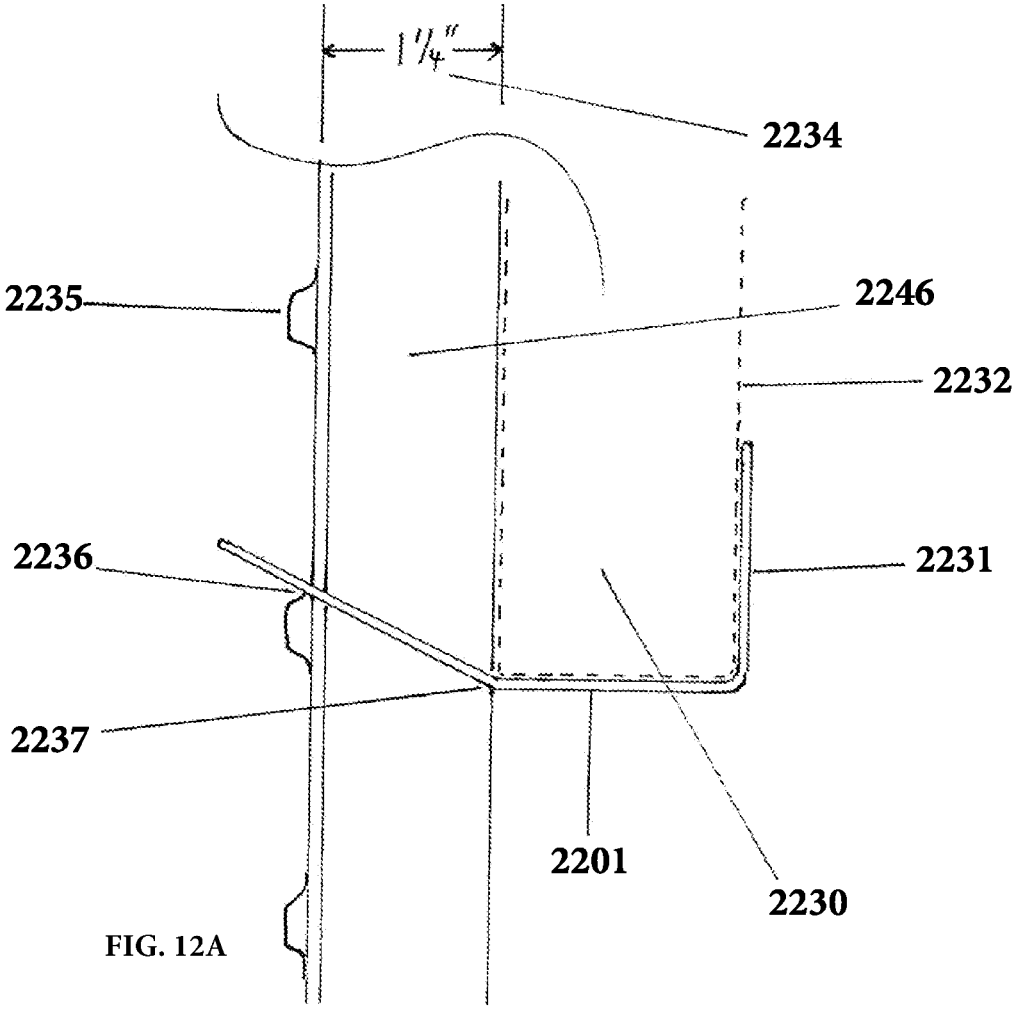
FIG. 12A is a side view of an installed fence bracket.
Figure 12B:
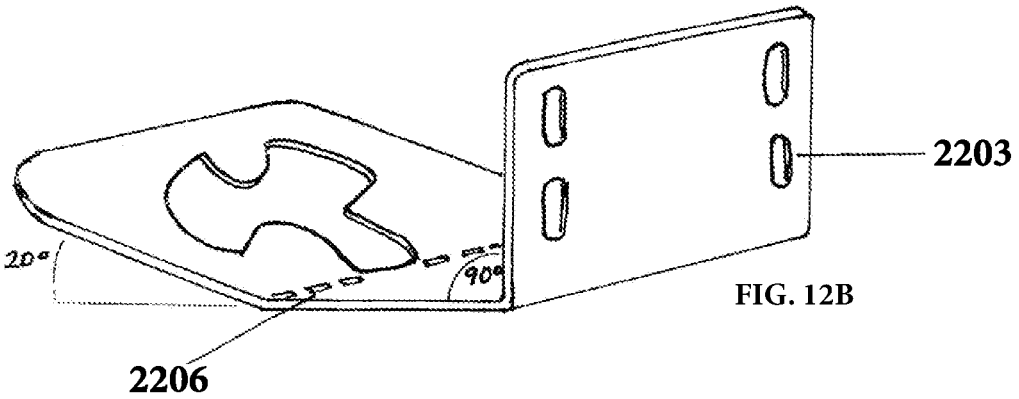
FIG. 12B is a perspective view of the fence bracket.

The cradle section 2201 is disposed to receive lumber or similar items and is, in the preferred embodiment, 1 9/16" wide. The cradle section 2201 is positioned between the mounting portion 2210 and the cradle flange 2231. The cradle flange 2231 serves as a stop and support for the mounted lumber. The bracket is bent approximately ninety degrees at the location of the bend line 2202 in order to distinctly form the cradle section and the cradle flange, as shown in FIGS. 12A-B. The bracket is bent approximately thirty degrees at the location of the perforated slots 2206.

The cradle flange 2231 includes a plurality of apertures 2204, preferably oblong in shape. The apertures 2204 can be used to securely attach the lumber to the bracket via screws or similar fastening means. The oblong shape of the apertures 2204 ensures that clear passageways for the fasteners are available when two fence brackets are used in conjunction, as discussed infra. The fence bracket may also include a guide notch 3000. A series of perforations or slots 2206 are positioned between the mounting portion 2210 and the cradle section 2201 from one side of the bracket to the other. These perforations 2206 allow for minor adjustments of the angle, in the field, in order to accommodate the use of t-posts having varying widths. The mounting portion extends at an angle between forty and forty-five degrees from the cradle section at the location of the perforated slots 1840.

Figure 11A:
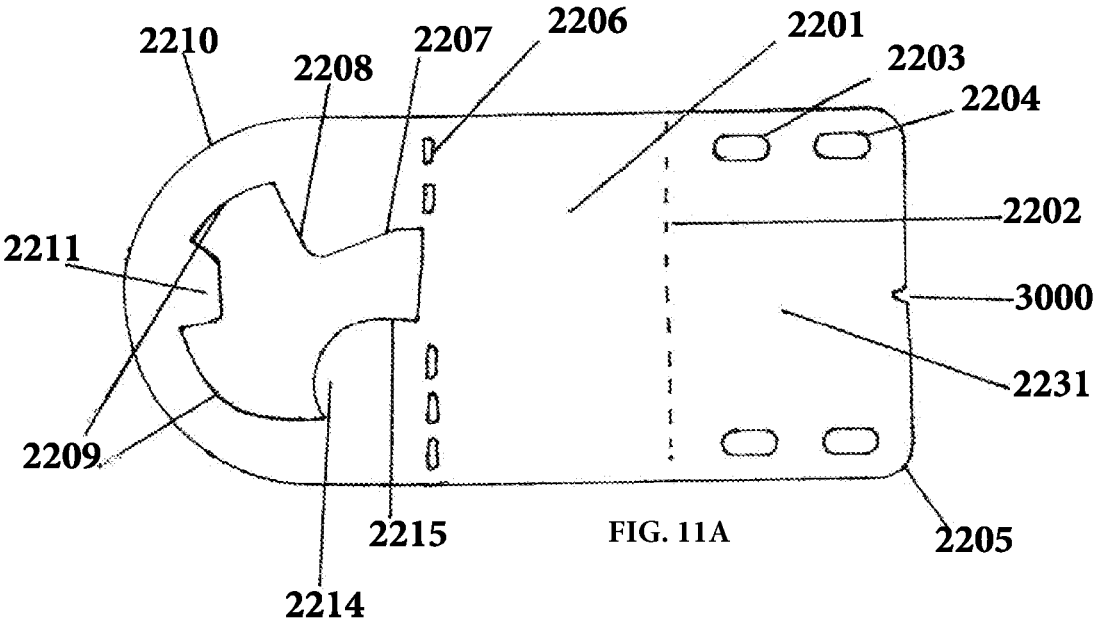
FIG. 11A is a top view of the fence bracket.
Figure 11B:
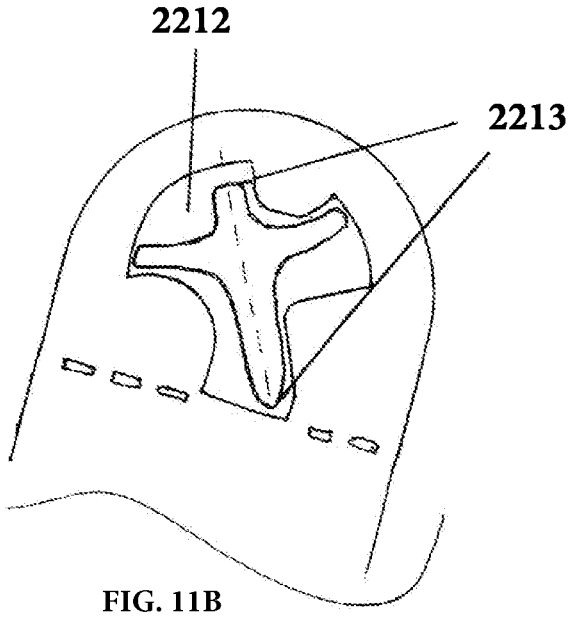
FIG. 11B is a planar view of the fence bracket during the installation process on a t-post.
Figure 11C:
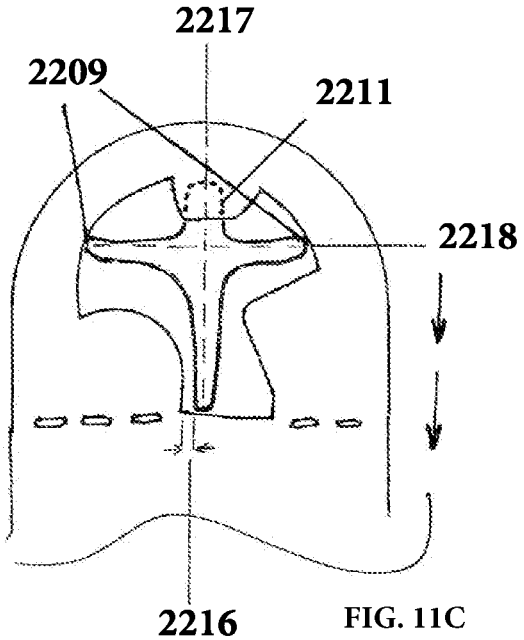
FIG. 11C is a planar view of the fence bracket installed on a t-post.
Figure 13:
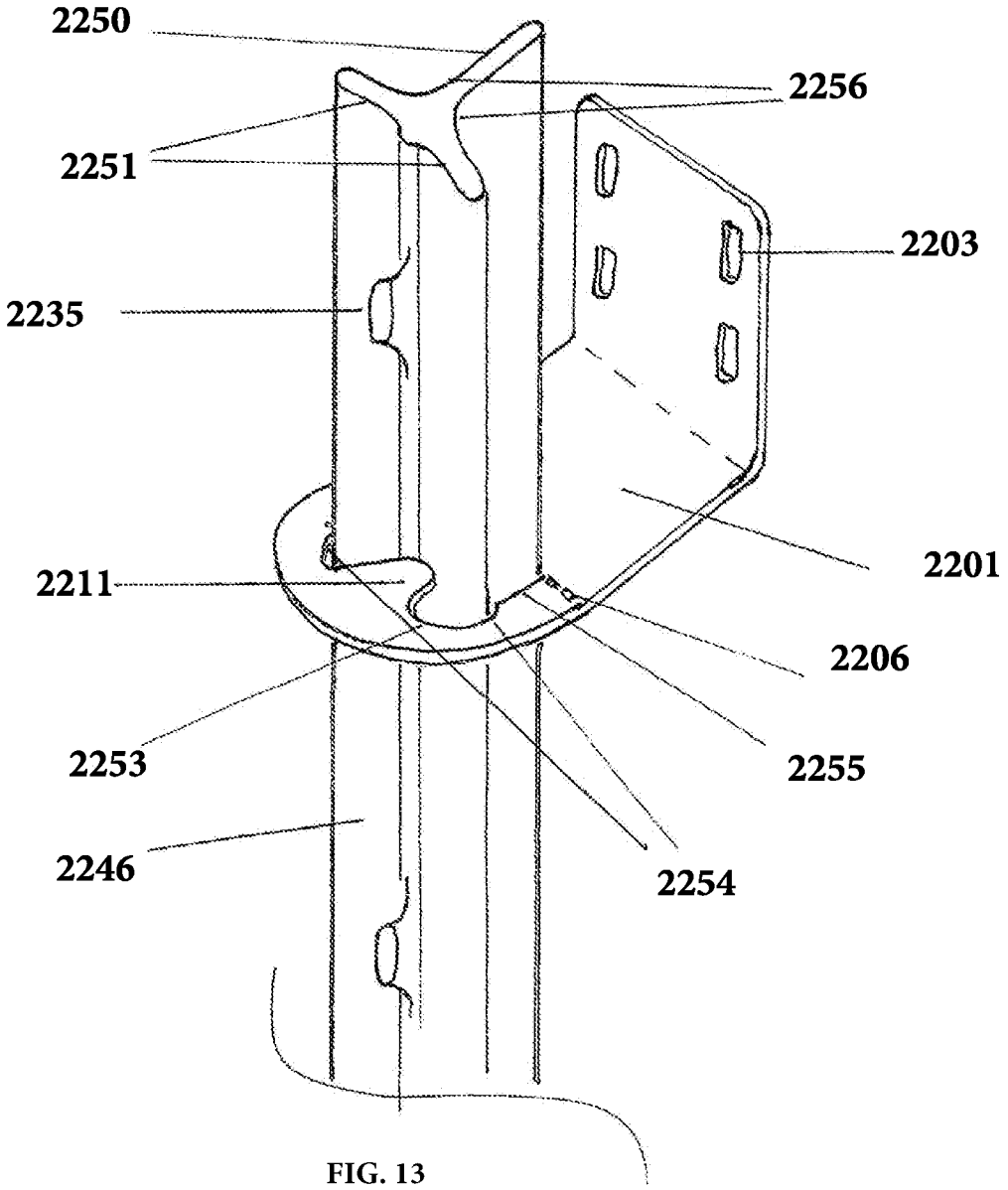
FIG. 13 is a perspective view of an installed fence bracket.

The mounting portion 2210 includes a specialized aperture or opening for securing the fence bracket to a t-post. The aperture is defined, in part, by two stop edges 2207 and 2208, two curved guides 2209, locking edge 2215, and a locking tab or tongue 2211. The stop edges 2207 and 2208 serve to guide the bracket down onto t-post during mounting. The first stop edge 2207 helps guide the bracket along the "T" portion of the t-post. The second stop edge 2208 helps guide the bracket on the "wing" section of the t-post. A curved guide 2209 helps guide the bracket for proper mounting and then lock the bracket into place. As shown in FIGS. 11B-C and 13, the curved guides 2209 receive the wings of the t-post 2251, respectively, in order to guide the bracket during installation and lock the bracket into position and to provide stability while locked. The curved guides 2209 prevent a front to back slide of the bracket. The locking tab 2211 is positioned over the t-post knob and also secures the bracket; specifically the locking tab 2211 prevents unwanted downward travel of the bracket. The opening provides an adequate amount of space 2212 to accommodate the wings of the t-post in order to help guide the bracket into a locked position and additional space 2213 to accept the widest portion of the t-post. Curved edge 2014 helps guide the bracket along the coves and then lock the bracket into place. Finally, stop edge 2215 serves to terminate the locking motion of the bracket and ensures the locking tab 2211 is centered over the knob of the t-post when mounted. The rounded corner on the end of the mounting portion of the bracket assists in the distribution of twisting torque generated by potential downward pressure.

The fence bracket is complimentary to the lumber bracket. It allows a user to mount any size of standard construction lumber at a right angle to lumber which has already been mounted on a lumber bracket secured to the same t-post.

Fence Bracket Installation

The fence bracket may be attached to all conventional sized t-posts and holds standard construction lumber on the side opposite the knob side of the t-post. The fence bracket's cradle will normally hold mounting lumber at 90 degrees to the t-post.

Figure 14A:
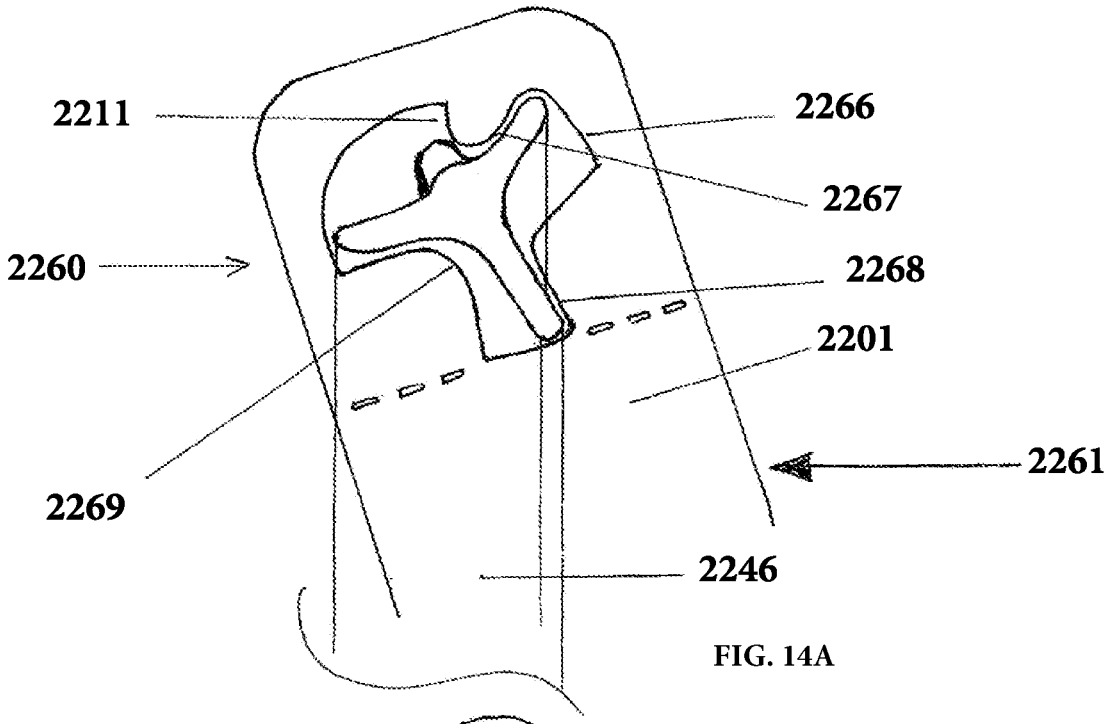
FIG. 14A is a perspective view of the fence bracket during installation process on a t-post.
Figure 14B:
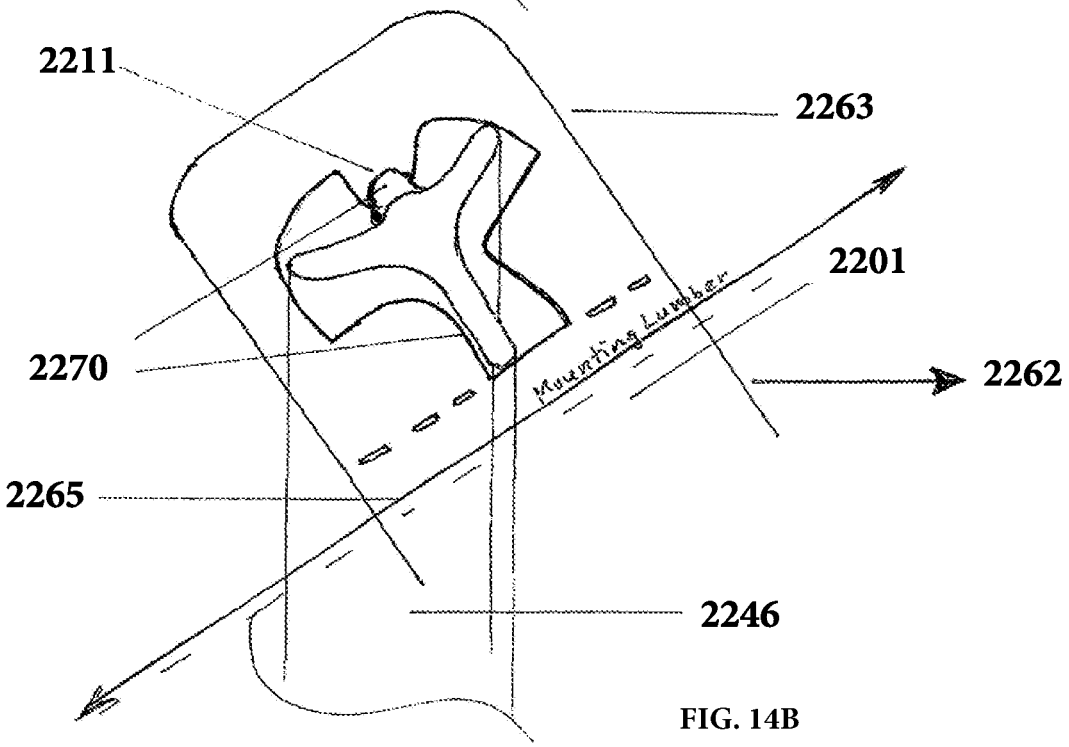
FIG. 14B is a perspective view of the fence bracket in locked position on a t-post.

FIGS. 13 and 14A-B, shows a perspective view of the basic installation and locking operation. Another view of this action is also reflected in FIGS. 11B and C. FIG. 14A shows starting position to allow bracket 2201 to slide down t-post 2246, to desired knob 2235 on the t-post. Following arrow 2261 in order to complete the mounting procedure, a user places bracket on top of t-post 2246, and applies slight pressure to left as shown by arrow 2261. After the bracket is slid down on post 2246 to desired position above a knob 2235, slight pressure is applied to the right 2262 to lock fence bracket into place. FIG. 14B shows top view and relationship between post and bracket in a locked position. The tongue 2211, of the fence bracket rests on top of a knob 2235 on post and will not allow downward movement along the t-post below the knob. When lumber is installed in the bracket, the downward pressure of the lumber pulls the curved guides 2209 toward the wings 2251 of the t-post thereby securing the metal against metal. Approximately five to ten degrees of adjustment is possible, without unlocking the bracket, to permit minor adjustments of the bracket in order to keep the lumber properly aligned.

Most t-posts include a spade which is positioned near the base of the post. The spade is driven into the ground and serves to secure the t-post. The spade, positioned below ground level, is able to absorb a certain degree of wind pressure or physical force, e.g. from animal contact with the t-post or wire attached to the post. The fence bracket cradle is oriented in parallel with the spade so that a board fence constructed with such means will benefit from the spade's ability to absorb wind pressure and force. This provides a distinct advantage over the use of wooden support posts in such a fence.

Lumber Bracket

Figure 8:
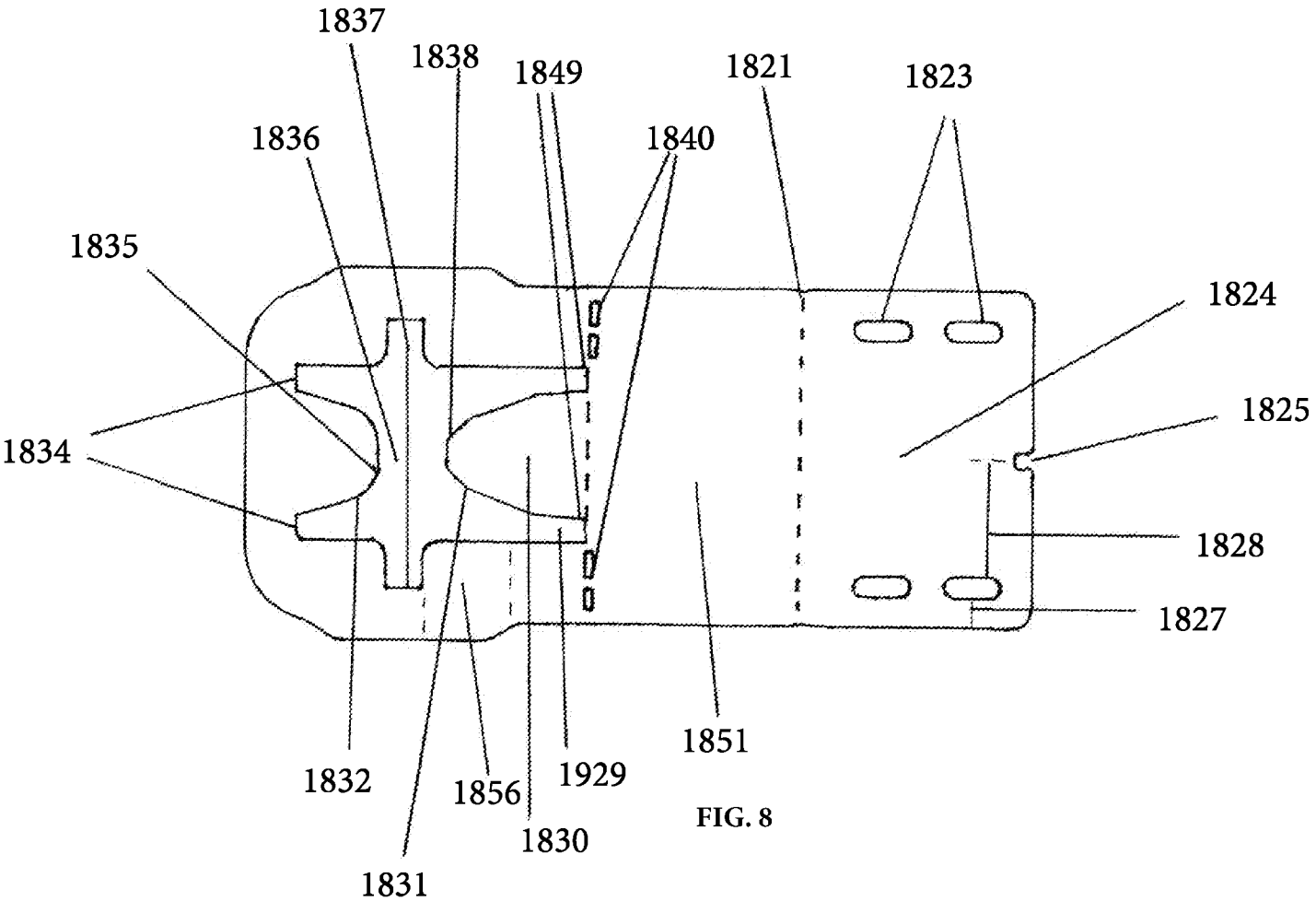
FIG. 8 is a top view of the lumber bracket.
Figures 9A, 9B:
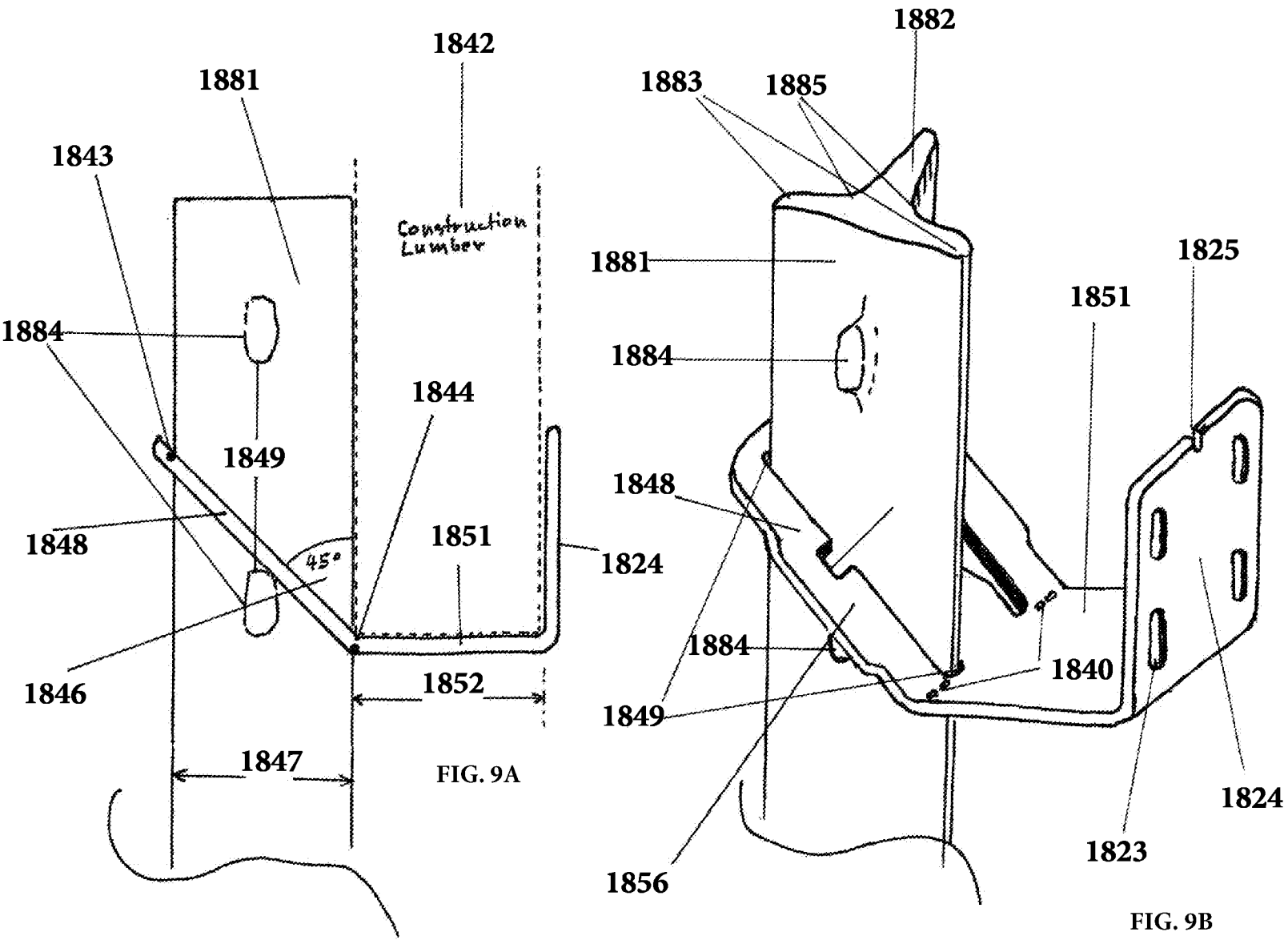
FIG. 9A is a side view of the lumber bracket when installed on a t-post.
FIG. 9B is a perspective view of the lumber bracket when installed on a t-post.

Referring now to FIGS. 8 and 9A-B, the lumber bracket can be mounted upon a standard t-post and is principally supported by one of the knobs 1884 on said post. The bracket includes a mounting portion 1856 and a cradle, the cradle being defined by a flat center portion 1851 and a cradle flange 1824 extending orthogonally from said center portion. The lumber bracket is reversible, i.e., it may be mounted on either side of the t-post and is able to hold lumber on either side of the t-post's knobs. The lumber bracket is designed to attach or mount standard construction lumber to the t-post.

As shown in FIG. 8, the cradle flange 1824 includes a plurality of apertures 1823, preferably oblong in shape. The apertures can be used to securely attach the lumber to the bracket via screws or similar fasteners. The oblong shape of the apertures ensures that clear passageways for the fasteners are available when two lumber brackets are used in conjunction, as discussed infra. The apertures 1823 are a suitable distance and position to prevent mounted wood from splitting as it is secured to the bracket. The distance 1827 of the apertures 1823 from the respective edges of the cradle flange 1824 ensures that the apertures 1823 will not tear due to high wind or other torque on the lumber bracket.

The lumber bracket also includes a guide notch 1825. The notch 1825 provides an accurate reference of the center of the cradle flange. A series of perforations or slots 1840 are positioned along the body of the bracket from one side to the other between the mounting portion and the cradle section. These perforations allow for minor adjustments in order to accommodate the use of t-posts having slightly varying widths.

The mounting portion includes a specialized aperture or opening 1836 for securing the lumber bracket to a t-post. The aperture is defined by a set of upper openings 1834, a set of lower openings 1849, two mounting notches 1837, and first and second locking tongues 1835 and 1838. The specialized aperture is used to guide the lumber bracket down a standard metal t-post 1881. The first tongue 1835 precisely guides the lumber bracket downward, along the cove 1885 of the t-post, and into a final locking position. To obtain a firm lock onto the post, the extended gaps 1829 allow the opening 1837 and tongue 1835 to slide down at an appropriate angle in order to lock onto post, and thereby, prevent side movement and assure the bracket's cradle will rest at a ninety degree angle to the wings 1883 of the t-post. As the bracket is secured against the wing 1883 of the t-post, the upper end of the opening 1834 will also lock against the opposite wing 1883 of the t-post.

In this locked position the side edge 1832 of the locking tongue 1835, will butt against the backside of the wing 1883 and the cove 1885 of the t-post. The locked back side is complimented by the elongated tongue 1830 as its central projection 1838 rests against the "T" portion-1882 of the t-post. The walls of the narrowed gaps 1829 are frictionally secured against the front and back part of the t-post's wing 1883. The angled edge on the tongue 1831 forces itself onto the cove 1885, of the t-post, completing the locking function. In that locked position, one of the chosen guides 1837 moves up diagonally allowing the bracket to rest on top of a knob 1884 of the post. This action moves mounting notch 1837 up and thereby beyond the t-post knob below, thus placing the reinforced area 1856, of the mounting section 1848 directly over the t-post knob on the t-post for maximum holding strength.

Lumber Bracket Installation

The lumber bracket is easily mounted with a few simple steps: With the knobs on t-post facing the user, the mounting area of the lumber bracket rests against the left cove of the post. With a slight pull to the right, the bracket will be in a position and able to slide down, over and passed the knobs, to its desired place on t-post. The lumber bracket is then raised diagonally on the left, to an angle of 45°, making it rest on top of a knob on the post. A slight downward pressure then locks the lumber bracket with its cradle at a horizontal position, utilizing the narrow extensions slots in the mounting area, eliminating sideways movement of the bracket, and locking onto the wings of the t-post and the top of the knob.

Figure 7A:
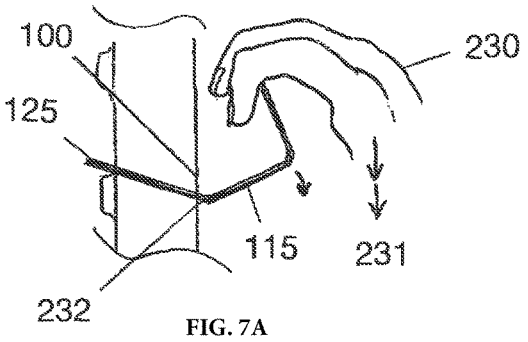
FIG. 7A shows a user adjusting a fence bracket during installation.
Figure 7B:
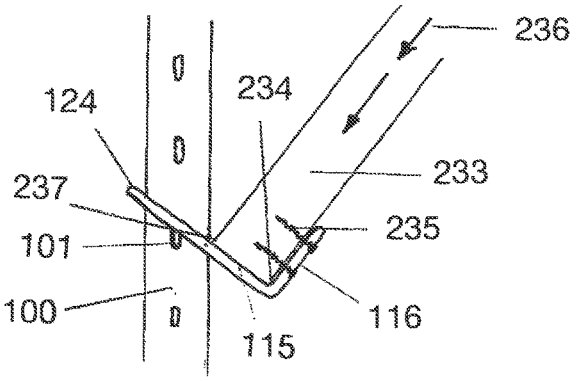
FIG. 7B illustrates the angle bracing technique.
Figure 7C:
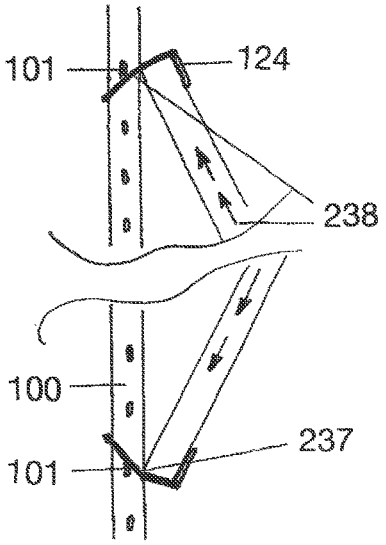
FIG. 7C illustrates the direction and use of pressure when installed.
Figure 7D:
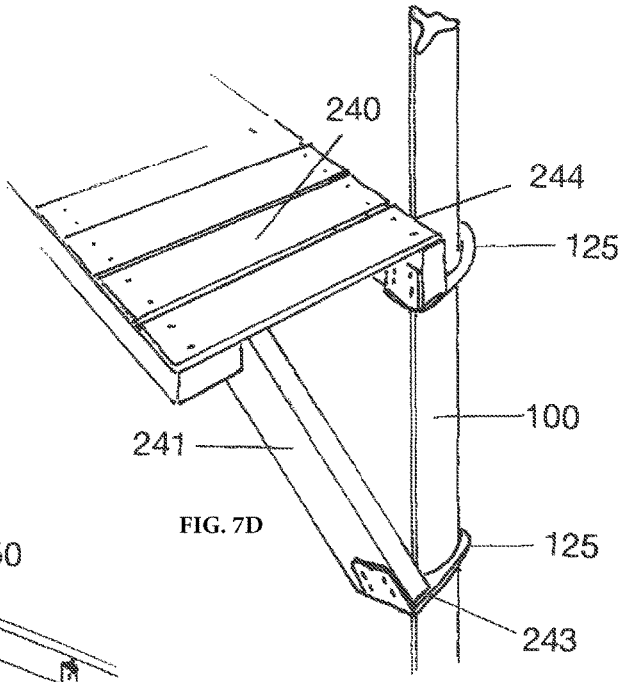
FIG. 7D shows a t-post having two fence brackets installed supporting a shelf.
Figure 7E:
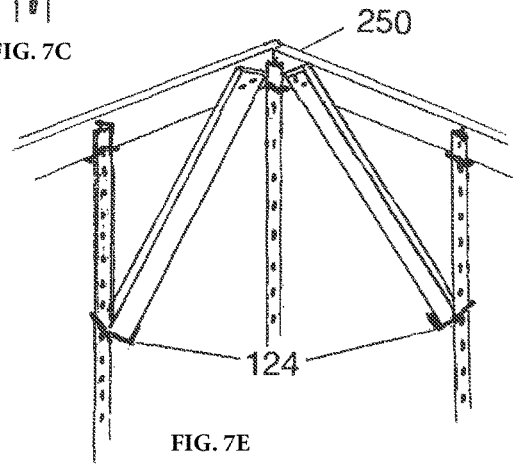
FIG. 7E illustrates wind bracing for the corner of a structure.

The mounted bracket provides a cradle section 1851 which can be used to hold standard size construction lumber in a vertical position as shown in FIGS. 7C-7E. Referring to FIGS. 7C and 9A, lumber is held vertically by the bracket's extended flange 1824, bent at 90° to the cradle 1851 and the wings 1883 of the t-post. This flange 1824 is parallel to the t-post's wing 1883 thereby creating a three-sided hold of the lumber applied. The reversible slide and lock method will hold vertical siding, fencing, or applied roofs and floors, from sliding down on either side of the metal post. This is accomplished by the angled portion of the bracket 1848 resting on the supporting knob 1884 on t-post 1881. The locked angled bracket rests, and is wedged in, on the edges 1849 of wings 1883 on the t-post 1881.

Referring now to FIGS. 9A-B, the width of the cradle 1851 holding the lumber is greater than the size of conventional dry lumber so swelling of wood by excess humidity will not prevent installation of the lumber.

The width 1847 of standard t-posts does not vary enough to affect the locking grip on the bottom of the 45° bend or on the wings of the t-post. The locked position will prevent a bracket loaded with lumber from sliding up or down or off the t-post. The space between the knobs on a conventional t-post is less than the height of the lumber in the bracket.

Figure 10B:
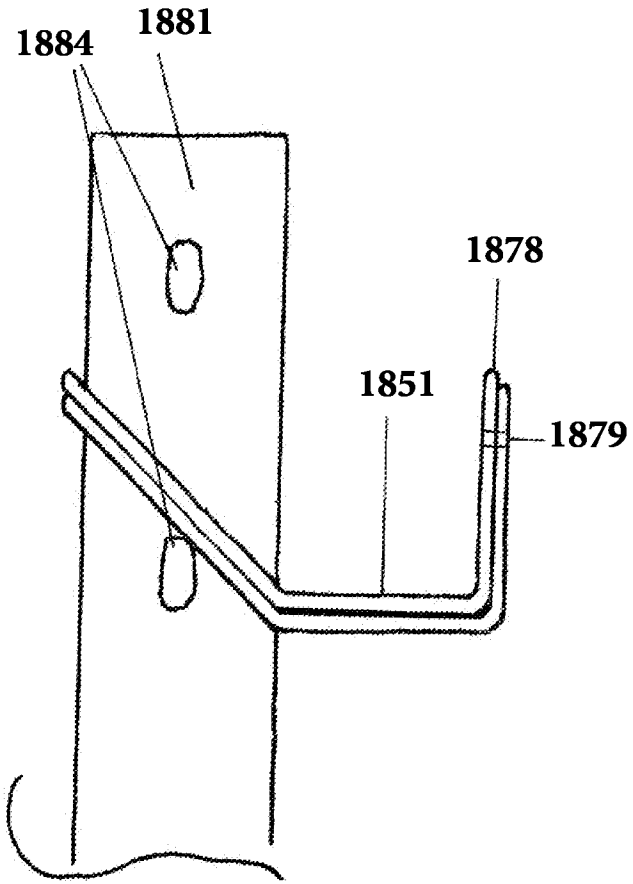
FIG. 10B shows two brackets jointly installed.
Figure 10A:
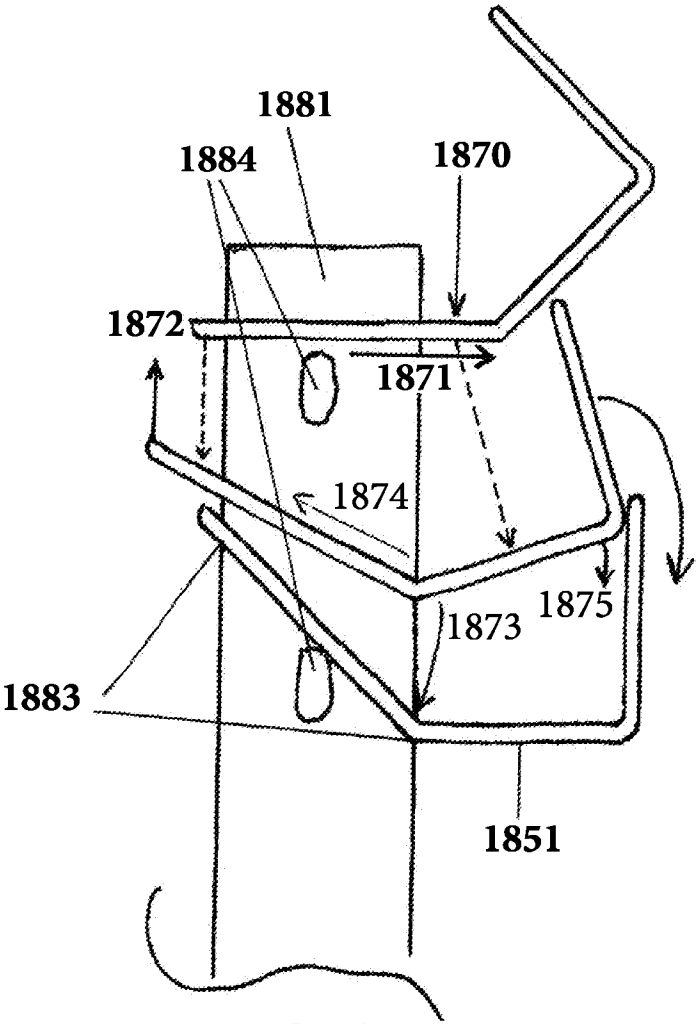
FIG. 10A illustrates the procedure for utilizing two brackets in one location.

In an alternate embodiment, two lumber brackets may be utilized co-axially or doubled-up, i.e., two lumber brackets, on top of one another, may be used instead of a single bracket. FIGS. 10A-B show a technique and method to double-up the lumber bracket, for increased strength. To double up, a second bracket is lowered 1870 (along the path of the arrows) until backside of mounting segment 1872 touches previously mounted bracket. This doubling creates the extension 1878 and slides the apertures 1823 such a distance in order to create a perfectly round hole 1879 to be used to secure the mounting lumber and also to attach the two brackets together.

Use of the System and Method for Construction

The lumber brackets and the fence brackets are designed to allow one to hang construction lumber on three sides of a standard metal t-post for a variety of purposes.

FIG. 1A illustrates a lumber bracket mounted on a t-post. The bracket rests at a 90° angle to the protrusions of the t-post knob(s). When the bracket is placed on the second knob-120, from the top of the t-post-100, the distance is less than the height of a standard 2×4" piece of construction lumber. This creates a lumber work area above the supporting posts to proceed with the roof construction; may it be a flat roof, a gable roof, or a tin roof on purlins. The lumber bracket 124 can be mounted on any knob-101, on the t-post, by sliding along the length of the t-post.

The vertical edge 104 of the t-post 100 runs the length of the post. This edge creates a parallel vertical rest 104 for the lumber that is mounted on the post. Each piece of lumber is also held with screws through the bracket's flange 116 on either side of the wing 102.

Figure 1B:
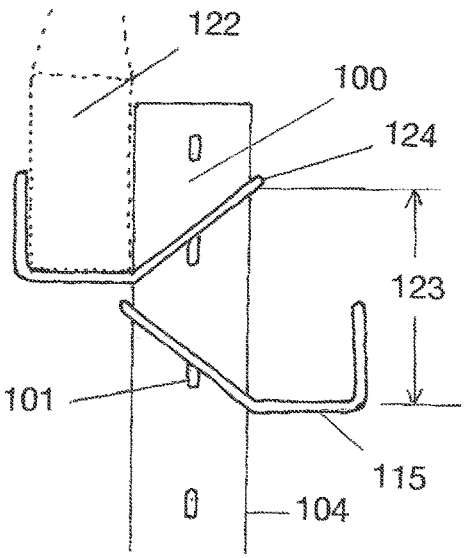
FIG. 1B is a side view showing two lumber brackets installed on a t-post.

FIG. 1B, shows the lumber bracket 124, in a first position and then a second lumber bracket in a reversed position, in relation to the t-post. This feature creates an option to mount lumber on either the outside for siding on a shed, barn or coop, or, alternatively, walls, or shelves on the inside of the project. The lumber 122 runs at a right angle to the knob side of the t-post. The total distance 123 between the cradle of the second lumber bracket and the tip of the locking portion of the first lumber bracket is 3½", which is the standard height of a 2×4" piece of construction lumber. This space permits the second portion of lumber to rest flush against the wing 104.

Figure 1C:
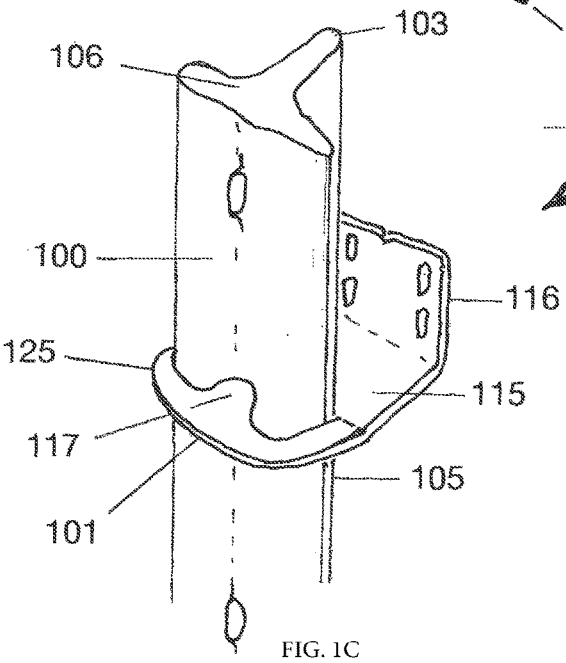
FIG. 1C is a perspective view of a fence bracket installed on a t-post.

FIG. 1C, shows the mounted location of the fence bracket 125 on a standard metal t-post 100. In this use, the bracket is installed over the second knob 101 of the t-post and secured by locking tab 117. At this position the construction lumber will be above the end of the t-post-106 and ready to receive all types of roof supports. The fence bracket may be moved down, or up, along the edge of the "T" 103 of the t-post. The position of the fence bracket is at a 90° angle to a mounted lumber bracket. The cradle 115 for lumber placement is at a 90° angle to the "T" edge 105 of t-post. This in essence, along with the lumber bracket, utilizes all three straight edges on a t-post 100, to hang and hold construction lumber. With the fence bracket locked in place, its flange 116 is parallel to the edge 105 and ready to receive lumber.

Figure 1D:
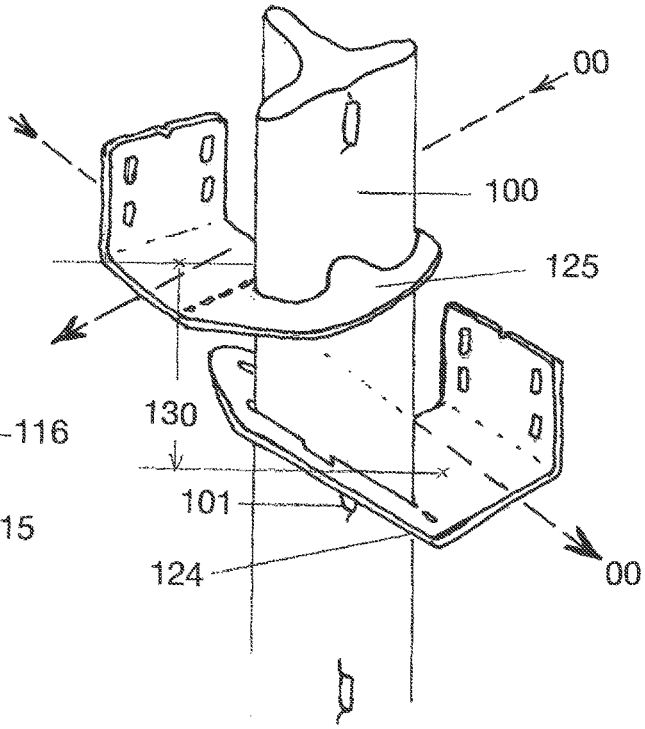
FIG. 1D is a perspective view of both a fence bracket and a lumber bracket installed on a t-post.

FIG. 1D, shows standard metal t-post-100, holding two brackets, 124 and 125. This combination works on any part, up or down, of the t-post 100. Note arrows-00, indicating the direction of the long axis mounted lumber on both of the brackets. In this orientation, the space between the cradle of each of the two lumber brackets is 2" 130. This distance is less than the standard distance between the t-post knobs 101, which is 2¼". Since the difference in height of each size of construction lumber is 2", e.g., 2×4, 2×6, 2×8, etc., this design allows one to place the next size larger lumber, at a right angle, on the lower bracket, and achieve the same top height, ready for a roof or floor. This is especially useful to hang a header, over a door or a tractor entrance, coming from a corner.

Figure 2A:
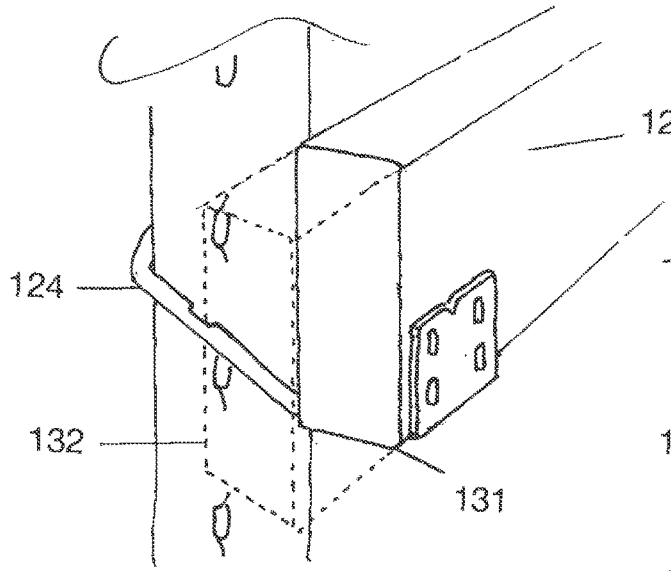
FIG. 2A is a perspective view showing the lumber bracket in use.
Figure 2B:
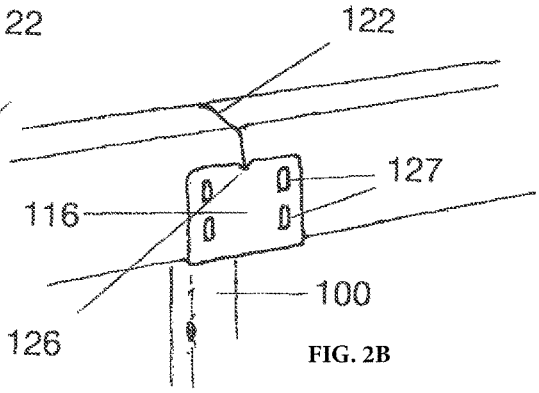
FIG. 2B is a perspective view showing a bracket in use.

FIGS. 2A through 2D show the use of the brackets for mounting of construction lumber. FIG. 2A shows a piece of lumber 122 mounted on a lumber bracket 124. The lumber may be cut flush with bracket 131 and the edge of the t-post. The lumber may also be extended by 1½" beyond the edge of post, as shown by dotted line 132, to allow a right angle mount. FIG. 2B shows a bracket, which can be either the lumber or fence bracket, locked onto t-post-100 and holding the butt edges of two lumber 122 ends. The center notch 126 of the bracket is used to align both sections of wood 122. Two slanted apertures, or screw holes 127, on each side of the flange 116, on bracket, are provided to secure each lumber-122, to the bracket. Lumber may be mounted on any appropriate section, up or down, on the t-post 100.

Figure 2C:
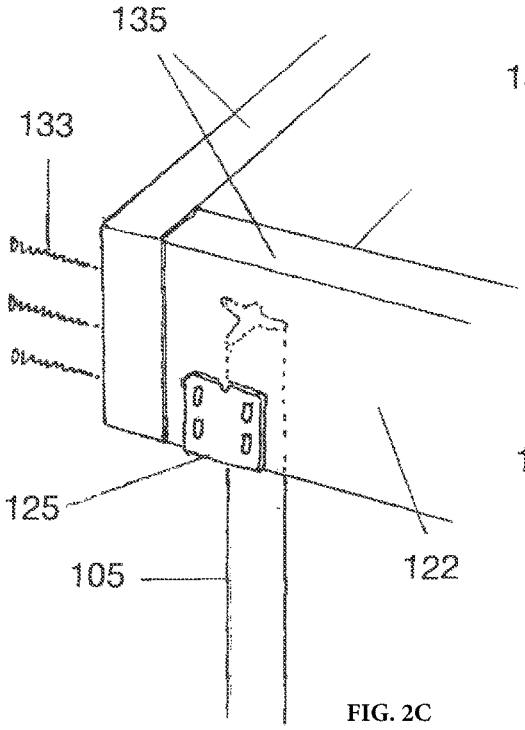
FIG. 2C is a perspective view showing the fence bracket in use.

FIG. 2C shows larger lumber 122, mounted from a fence bracket 125. The t-post's "T" edge 105 holds lumber upright to form a corner to receive a roof 135. Suitable fasteners, e.g., screws 133 are then used to finish the corner.

Figure 2D:
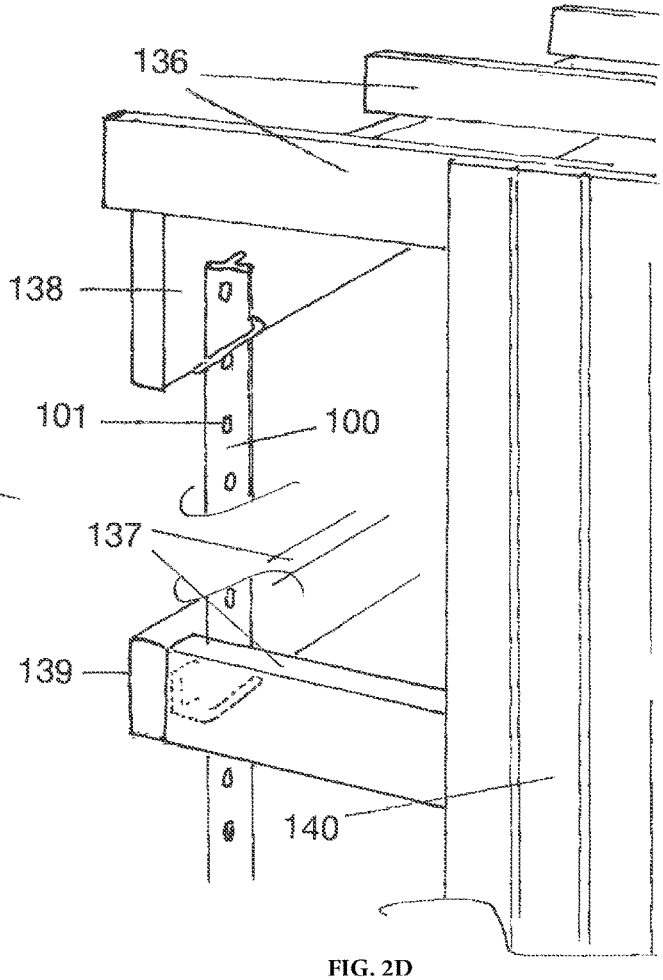
FIG. 2D is a perspective view showing the lumber bracket in use.

FIG. 2D illustrates one potential use of a lumber bracket to mount roof purlins 136 from a corner t-post 100. The supporting lumber 138 is extended 1¾" from the post in order to extend the lumber beyond the knobs 101. By design, said knobs protrude ¼" from the t-post 100. To match the above alignment, it is necessary to use the right angle arrangement of a bracket to form a corner for the mounting lumber 137. Such lumber can then be used to affix a board or panel siding 140, as required or desired.

FIGS. 3A-D show the use of either the fence bracket 125 or the lumber bracket 124 to convert an existing wire fence into a board fence. The drawings also illustrate the possible use of a portion of the board fence as a wall or walls for a shed, such as a firewood shed or mower shed.

Figures 3A, 3B, 3C, 3D:
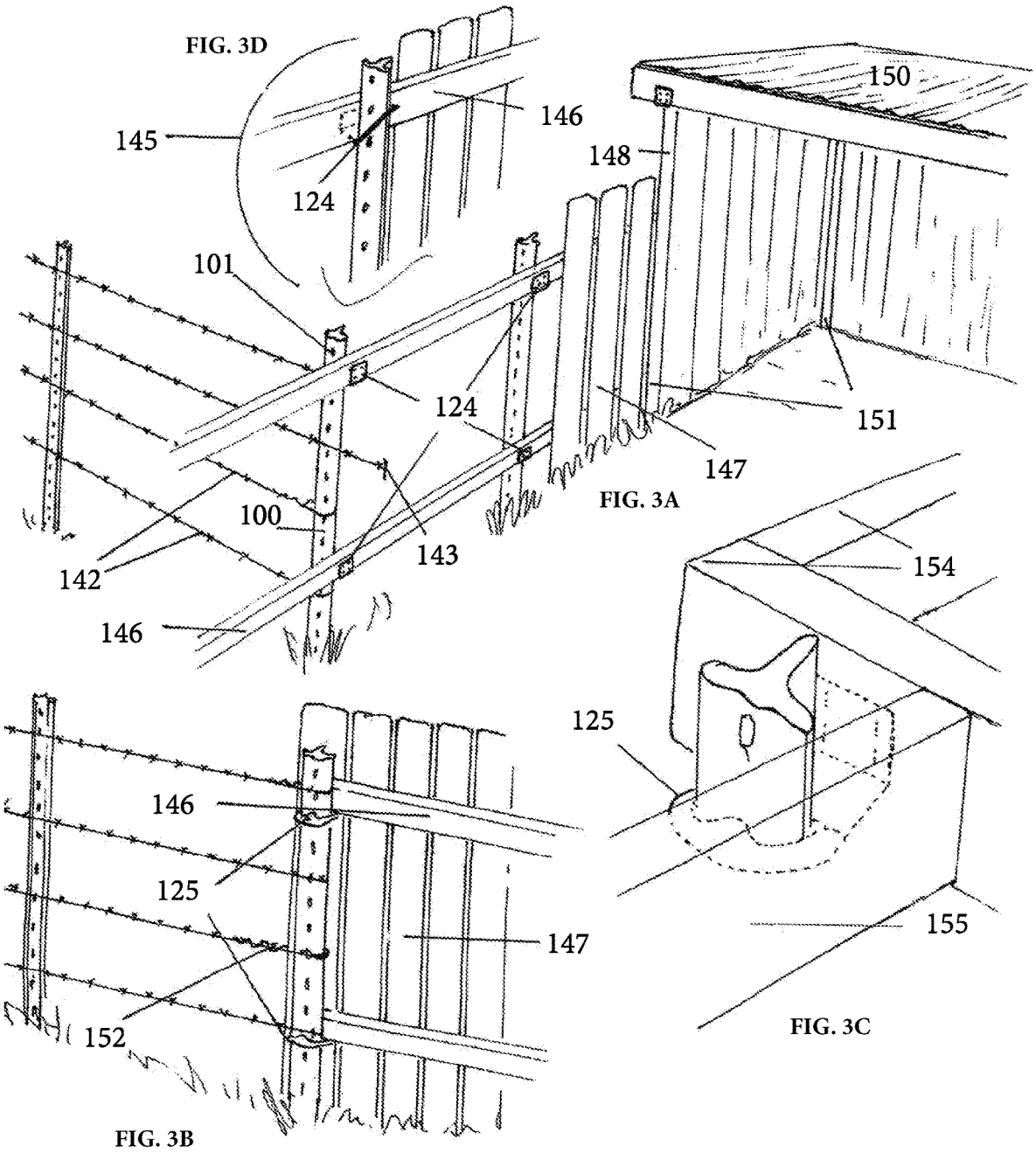
FIG. 3A illustrates various installations and uses for the system.
FIG. 3B illustrates a conversion from a wire fence to a board fence.
FIG. 3C shows the fence bracket in use during a conversion to a board fence.
FIG. 3D shows further detail of a conversion to a board fence.

FIG. 3A shows a right angle switch from a barbed wire fence, or other farm fence, to a backyard board fence. It will be noted that the fence wire 142, is conventionally on the knob 101 side of the t-posts, as reflected in FIGS. 3A and 3B. In order to make the switch from an existing t-post wire fence and install the board fence, one loosens the fence wire 142, cuts it, then wraps the wire around t-post 100, which becomes the corner post. While wires are temporarily removed, the two lumber brackets 124 are slid unto the corner post to hang mounting lumber. This arrangement could also become the end of a farm fence, ending at a 90° angle to a backyard fence, by simply extending mounting lumber 146, to the left of corner post. As shown in FIG. 3D, one can use the reverse method of the lumber bracket 124 to mount mounting lumber 146, and thereby face the fence boards to the left or opposite side.

FIG. 3A also shows a shed in the corner of a board fenced backyard. The user switches to a taller t-post 148, to allow head clearance to enter shed 150. Siding inside shed can continue as shown on the page. Corner post 151 and rear post can be turned, and appropriate brackets used, to face boards 147 in or out.

FIG. 3B shows a conversion from a barbed wire fence to a board fence along a straight run. Without the removal of any posts driven into the ground, the wires are removed and fence bracket 125 are slid onto posts. Mounting lumber 146 is inserted into the brackets, then boards 147 are added. The wire fencing is reconnected 152, even with mounted end board attached. The boards are 1½" from the t-posts 100, which makes it easy to re-install the farm fencing wires.

FIG. 3C shows an option either to continue in line with the wire fence, or to create a board fence corner 154, by using a fence bracket 125, on any t-post previously used for farm fencing already in the ground. This corner can go either to the right 154, or to the left 155, depending what side the mounting of the fence boards are desired.

Figure 4A:
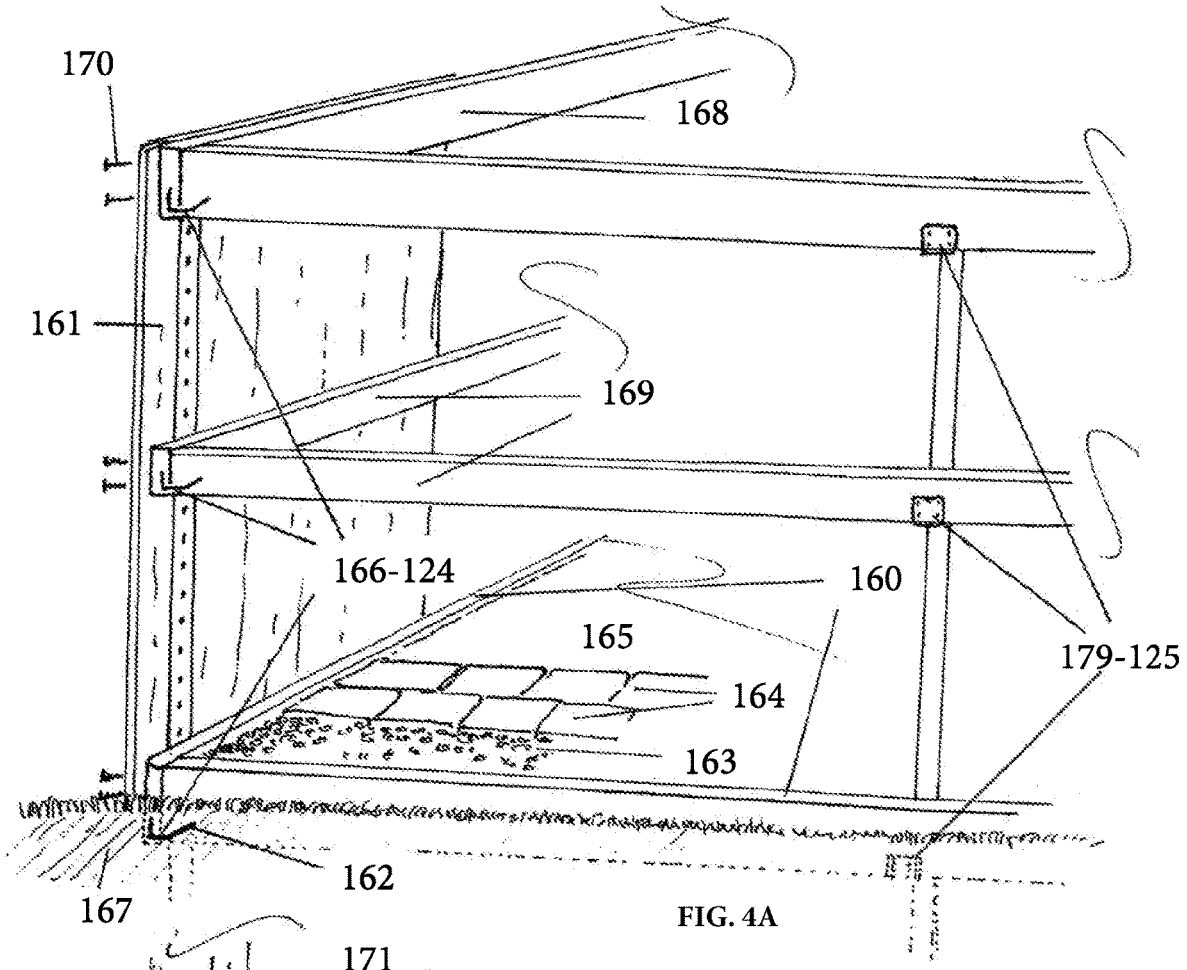
FIG. 4A illustrates various installations and uses for the brackets.

FIGS. 4A and B show the construction of an enclosed structure, able to withstand greater environmental forces, which can be semi-permanent or permanent in nature. The use of 8', 9', or 10' t-posts allows such posts to be driven to sufficient distance into the ground so that they can serve as anchors to hold 2×8" weather treated floor edging 160 or to pour concrete 165 against or butt up pavers 164 or gravel 163. Utilizing one of the foregoing flooring methods would be integral to forming the base of a more permanent, potentially frost-free, structure.

Treated siding sheets can be attached to the t-post structure with nails or screws. These sheets can terminate at ground level or extend below ground level 167. The attached siding 161 on joining corners serves as a strong corner wind brace. This wind corner is mounted on the header 168, above, and on a suitable board on the bottom 160 of the structure and also attached to the wood support bars 169, on both sides of corner. This structure can also receive an inside framed wall with insulation and covered with sheetrock.

Figure 4B:
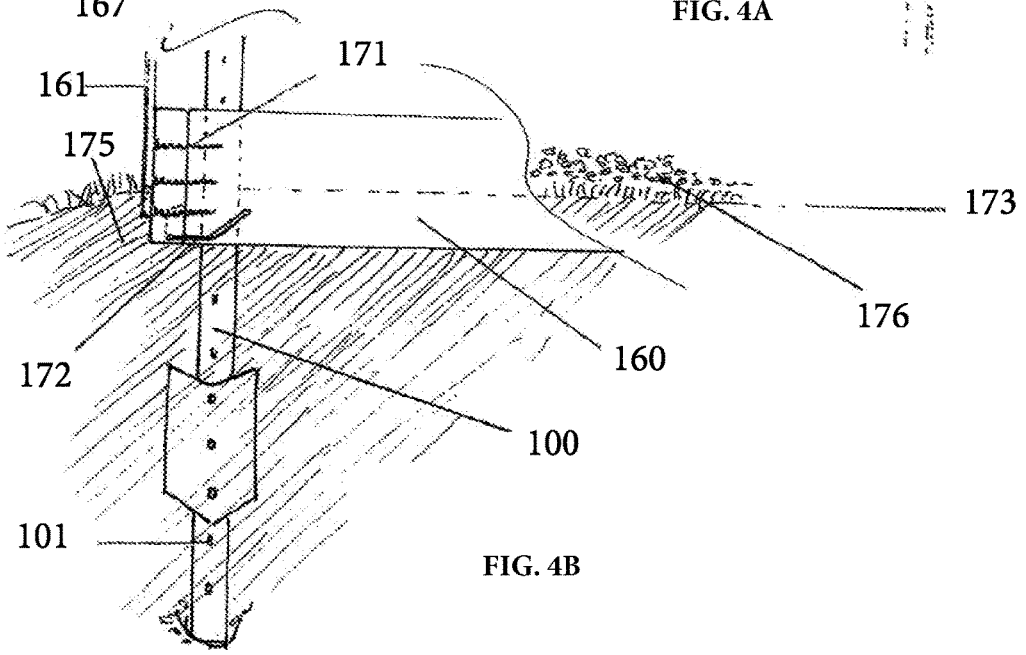
FIG. 4B shows the base and below ground components of the system in use.

Referring still to FIGS. 4A-B, depending on the placement of the t-posts 100 and required orientation of the boards, either lumber bracket(s) or fence bracket(s) may be used to achieve the same desired combinations.

FIG. 4B, shows a below ground corner structure. Note the following in such drawings: the ground level 173 and backfill 175, and placement of a galvanized bracket 172, holding the mounted ground level treated lumber 160, and the treated siding 161, partially below ground. Screws 171 are used to secure both the lumber and bracket into a weather and decay proof unit. T-post 100, is well below ground level 173, with spade 174 of the t-post providing strength against flex.

Figure 5A:
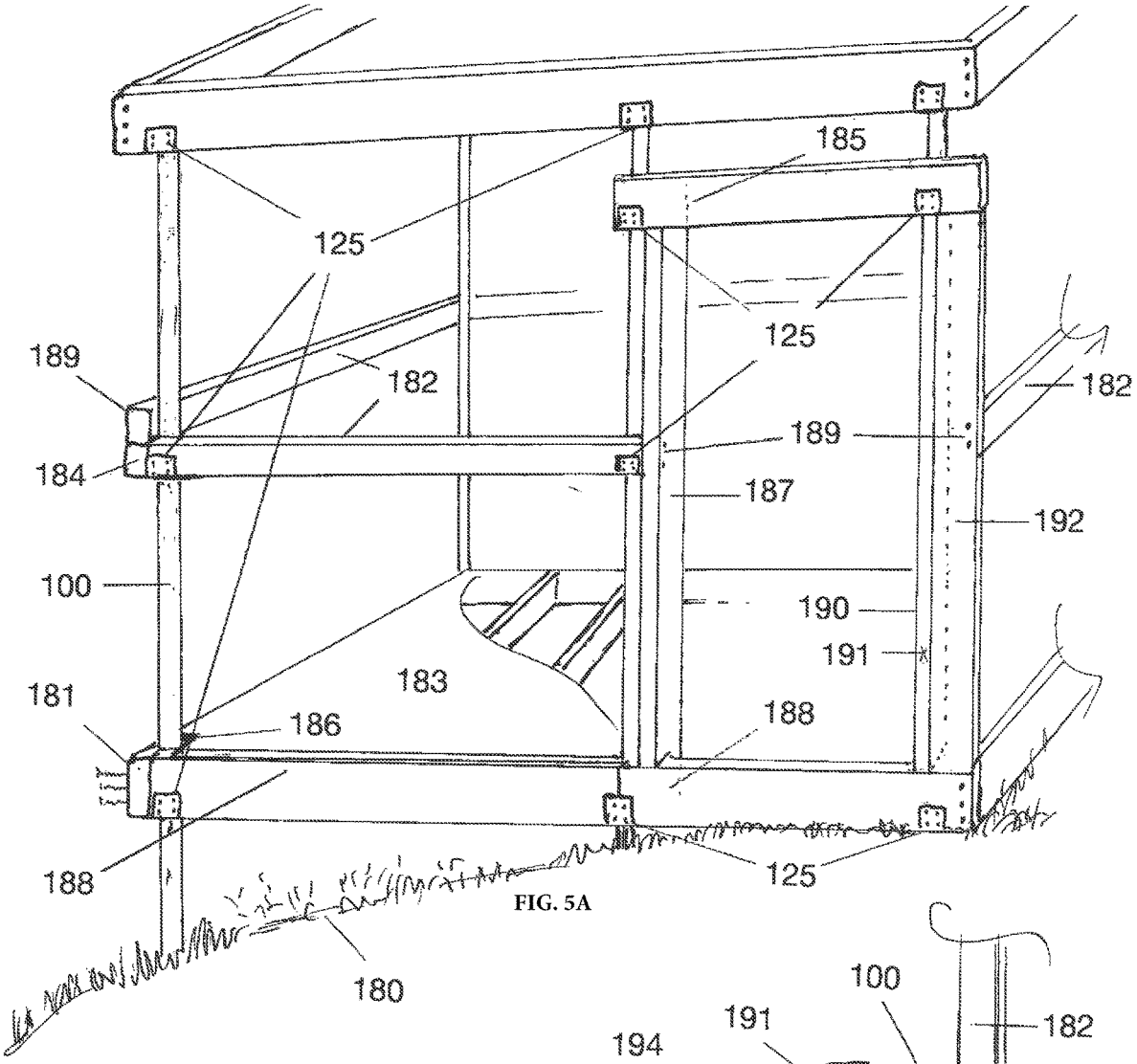
FIG. 5A depicts the use of the system to construct a coop.

FIGS. 5A and B, shows another outdoor structure, i.e., a coop, with the frame for a door. The base support structures for the coop can be partially, or entirely, above ground 180. Left corner t-post 100 and both doorjamb posts use fence brackets 125.

Plywood 183, or other flooring, is extended over the support lumber 188. A notch 186, is cut to wrap the flooring around the t-post 100. The left doorjamb 187 is turned to a right angle to the t-post 100, secured to the mounting lumber 182, notched and screwed to the treated floor support 188, and header 185.

Figure 5B:
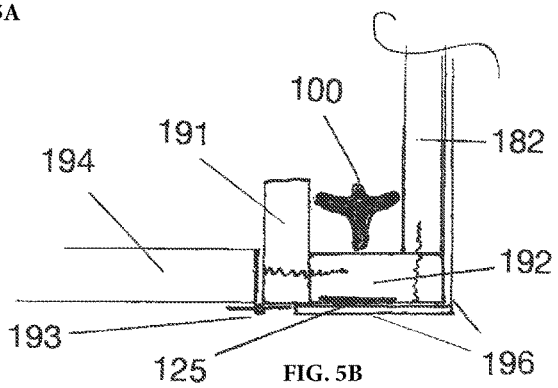
FIG. 5B is a detailed view of the corner assembly of the coop.

The hinge side of the door opening 190, shows the ground fence bracket 125, presenting a flat joint to attach the doorjamb 191, to the vertical corner support 192, and header 185, and floor joist 188. FIG. 5B shows a top view of corner assembly. With the t-post 100, turned, matching others on same side, the fence bracket 125 holds the treated, ground lumber 188. (see FIG. 5A) The doorjamb 191 is secured to the vertical corner support 192, so it will cover the mounting lumber 182, the brackets used. It has enough extension of the jam to mount the hinges 193, to hang door 194. All this can then be covered with siding 196, if desired.

Figure 6A:
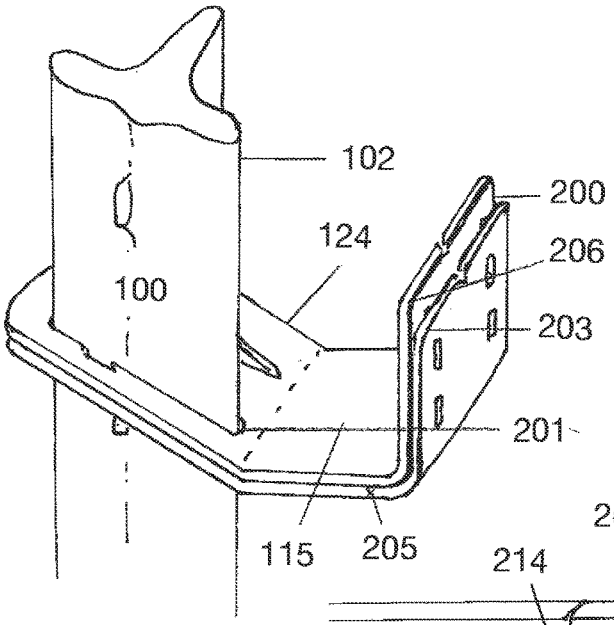
FIG. 6A shows doubled-up lumber brackets.

FIGS. 6A-E show the use of double brackets. FIG. 6A shows lumber brackets 124, doubled up. The distance between the slightly elongated guides 201, being locked to the wing 102 of t-post 100, creates a distance to the height of the flange 203, of the first bracket in place 205. It is this distance needed to slip the cradle 115 of the second bracket 206 into and on top of the first bracket.

Figure 6B:
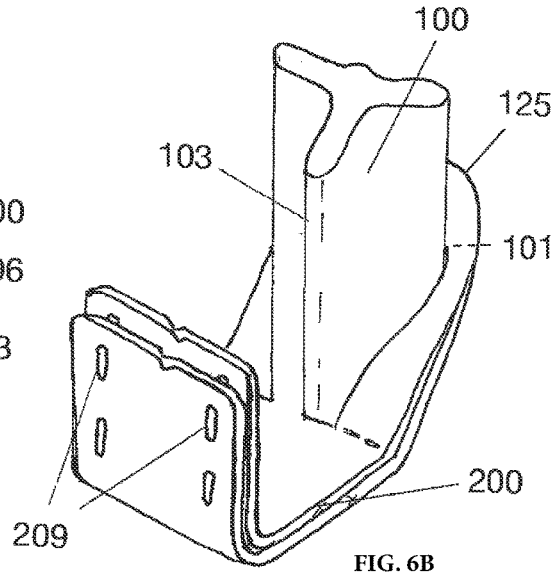
FIG. 6B shows doubled-up fence brackets.

FIG. 6B shows a fence bracket 125, doubled up 200, locked against the t-post's 100, T 103, and the post's knob 101, in the back. Method to achieve this doubling up is same as with the lumber bracket 124. Elongated screw holes 209, doubled up, will provide the proper hole-size for the mounting screws to enter and lock onto the wood.

Figure 6C:
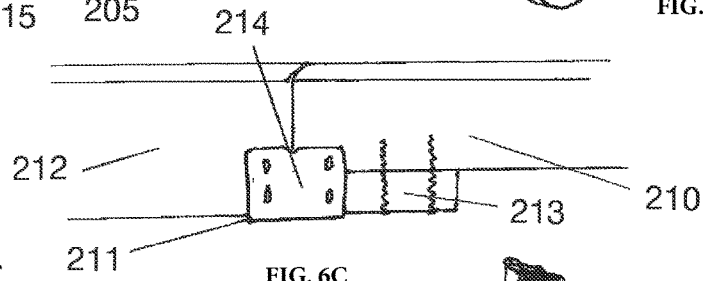
FIG. 6C illustrates a use of a spacer.

FIG. 6C shows a simple use of either bracket 211, doubled up. A smaller piece of lumber 210, shares the bracket with a next size larger lumber 212. A two inch spacer 213, long enough to be screwed to the underside of the narrower lumber 210, will convert it to the same size of the header 212. The two sizes of lumber are connected to each other with screws through each side of the flange 214. Such arrangement is suitable when a smaller mounting lumber, spanning a short distance between t-posts, must switch to a larger lumber, such as a header over a door opening.

Figure 6D:
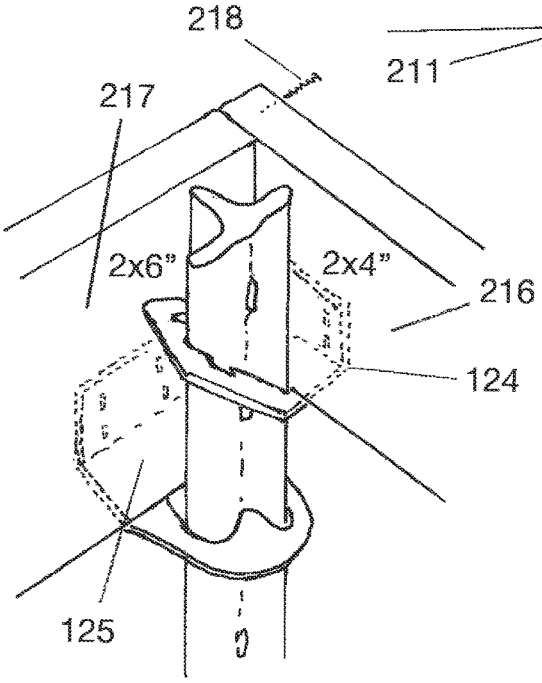
FIG. 6D shows the use of both types of brackets working in conjunction to form a corner.
Figure 6E:
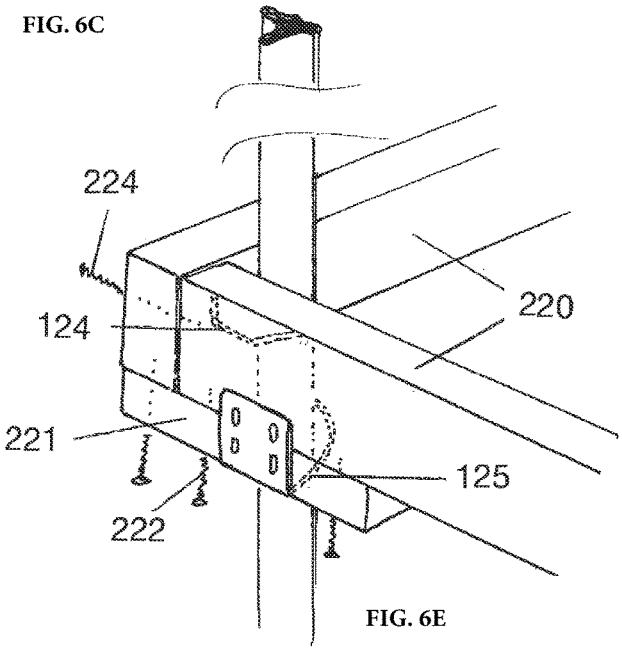
FIG. 6E shows an alternate view of two brackets working in conjunction to form a corner.

FIG. 6D shows a doubling up of brackets, at a right angle to one other, holding two sizes of lumber. This is done so a constructed corner does not have to depend solely upon two or three screws through wood to hold the corner together, which, when subject to a heavy roof structure may possibly collapse. As can be seen, a lumber bracket 124, holding a 2×4" 216 and concurrently a fence bracket 125, is holding up a 2×6" board 217. In addition to as many as four screws holding each lumber to brackets, additional screws through wood 218, provide for an exceptionally strong corner.

FIG. 6E again illustrates the use of each bracket, at a right-angles to one another, to create a corner made of the same size lumber 220. As in FIG. 6D, the fence bracket is slipped onto the post first. Cradle 115 is 2" below the cradle of the lumber bracket 124, above, at a right angle. This creates a need for a joining strip 221 of lumber to be placed, and secured with screws 222, to the lumber resting on the lower bracket 125. Again this provides an exceptionally strong corner with the additional screws 224 securing the two pieces of lumber together.

FIGS. 7A-F show the use, and ability, of either the lumber bracket 124, or the fence bracket 125, to be bent for angle bracing. FIG. 7A shows the user, using his hand 230, to pull on the mounted and locked bracket in order to adjust the angle of the cradle 115 and achieve a matching end of a right-angle squared lumber. The mounting of diagonal wood braces uses the same process identified supra, in order to match the cradle 115, to the end of squared lumber. The hand's fingers 230, pulls down 231, to create the desired position the cradle 115. Perforated slots 232 allow the user to achieve the correct bend.

FIG. 7B shows basic angle bracing, wood against metal. The adjusted bracket 124 rests on the knob 101 on a t-post 100. The lumber 233 is squared up in the cradle 115 and the 90° flange 116. These two sides of the bracket are permanently at a 90° angle 234. With screws 235, in place, the lumber and the bracket become one unit. The direction of the arrows 236 indicates the pressure applied by the wood against metal of post 237 which serves to complete the mounting function with the end of the lumber covered with the metal of the bracket. FIG. 7C shows option of downward pressure 237, with bracket holding lumber, locked on top of a knob 101, on t-post 100. Pressure 238, shows same principle, pressure going up the post 100, and lumber bracket 124, with lumber locked under a knob 101.

Figure 7F:
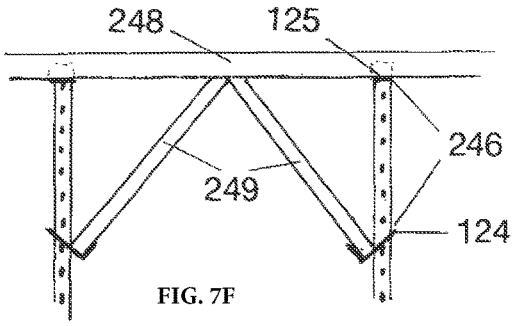
FIG. 7F shows both fence and lumber brackets being used to hold up roof support.

FIG. 7D shows t-post 100, holding two fence brackets 125. The top bracket 125 holds the wall edge 244 of a shelf. The same type of bracket below shows, its cradle 115, aligned 243, to hold angled lumber 241, holding shelf 240. FIG. 7E shows wind bracing on a corner structure. Post on left shows lumber bracket 124, holding up lumber diagonally, bracing the corner post assembly 250. Similar combinations of brackets 124-125, will accomplish the rest of the corner, depending how the user has placed the t-posts 100. FIG. 7F shows bracing holding up roof support 248, with fence brackets 125. They are at a right angle 246, on both sides, to the bottom lumber brackets 124, holding support lumber 249.

The brackets will not slide down the long axis of the t-post due, in part, to weight of lumber mounted. When the brackets are placed and locked, a portion of the metal bracket rests on top of the t-post knob.

While the invention has been described in reference to certain preferred embodiments, it will be readily apparent to one of ordinary skill in the art that certain modifications or variations may be made to the device without departing from the scope of invention described in the foregoing specification.

The invention claimed is:

1. A bracket for mounting construction material upon a t-post comprising:

a cradle section disposed to receive construction material:

a mounting portion: said mounting portion extending at an angle from said cradle section of essentially thirty degrees relative to the cradle section and having a mounting aperture;

said mounting aperture comprising two stop edges, two curved guides, a curved edge, locking edge, and a locking tab; and, a flange extending orthogonally from one side of said cradle section: said flange having at least one aperture on a body of said flange.

2. The bracket of claim 1 further including a guide notch.

* * * * *